United States Patent [19]

Gardner

[11] Patent Number: 4,479,303

[45] Date of Patent: Oct. 30, 1984

[54] CHAIN SAW ATTACHMENT

[76] Inventor: Douglas S. Gardner, 427 Peters Rd., Randle, Wash. 98377

[21] Appl. No.: 458,238

[22] Filed: Jan. 17, 1983

[51] Int. Cl.[3] ..... B27B 17/02

[52] U.S. Cl. ..... 30/383; 30/122; 83/790; 144/208 J

[58] Field of Search ..... 144/208 C, 208 J; 30/383, 122; 83/790

[56] References Cited

U.S. PATENT DOCUMENTS

| | | | |
|---|---|---|---|
| 2,708,468 | 5/1955 | Lantz | 83/790 X |
| 2,783,794 | 3/1957 | Kroll | 83/790 X |
| 2,821,216 | 1/1958 | West et al. | 144/208 J |
| 2,889,860 | 6/1959 | Bagley | 83/790 X |
| 3,073,073 | 1/1963 | Van Pelt | 83/790 X |
| 4,317,285 | 3/1982 | Graham | 30/382 |

FOREIGN PATENT DOCUMENTS

| | | | |
|---|---|---|---|
| 663011 | 5/1963 | Canada | 144/208 J |
| 2543288 | 3/1977 | Fed. Rep. of Germany | 144/208 C |

*Primary Examiner*—Jimmy C. Peters
*Attorney, Agent, or Firm*—John O. Graybeal

[57] ABSTRACT

A chain saw attachment for mounting on a portable power-driven chain saw having a saw bar and an endless saw chain disposed for movement around the saw bar, the chain saw attachment consisting of: (a) a cutting head assembly including a first wheel having a central axial aperture and slots in the perimeter of the wheel for receiving four cutting knives; a second wheel having a central axial aperture and slots in the perimeter of the wheel for receiving four cutting knives; a drive sprocket positioned between the two wheels, the drive sprocket being adapted to receive and be driven by the chain; eight cutting knives, the cutting knives being individually positioned in the slots in the perimeters of the first and second wheels and held in the slots by set screws; and three bolts for holding closely together in a unitary assembly the first and second wheels and the drive sprocket; (b) an axle extending through the central axial apertures of the first and second wheels, the ends of the axle extending normally outwardly from the center of the wheels; and, (c) two mounting arms receiving the end of the axle, the mounting arms being adapted to be bolted to the saw bar so that the axle is held in a plane perpendicular to the plane of the saw bar. The chain saw attachment may also include a safety cover located above the cutting head assembly.

5 Claims, 11 Drawing Figures

CHAIN SAW ATTACHMENT

BACKGROUND OF THE INVENTION (1) Field of the Invention

My invention is in the field of commercial logging operations and involves portable power-driven chain saws which are used to cut trees and logs. More particularly, my invention is in the field of attachments for power chain saws. The invention is used for debarking trees and logs and for cutting or shaping logs.

It is often necessary to use a power chain saw to cut trees and logs which are covered with abrasive materials, such as mud, dirt, or volcanic ash. For example, in the area around the volcano Mount St. Helens the trees and logs are all covered with ash from the recent volcanic eruption. When cutting such trees with a power chain saw, the abrasive materials covering the outside of the trees will act to dull and wear out the saw chain, will get into the chain groove, and will cause the saw bar to wear out much more quickly than under normal tree cutting conditions. In general, these abrasive materials greatly increase the normal cost of operating a power chain saw.

One solution to this problem is to use an ax to chop off the tree bark and foreign matter, but this is a slow process which also increases the cost.

(2) Description of the Prior Art

The prior art includes U.S. Pat. No. 2,708,468 to Lantz for a chain-drum rossing device which includes two curved rasp-type drums which are rotated by an idler sprocket wheel driven by the saw chain. Lantz also broadly mentions the concept of shields of a semi-cylindrical shape attachable as a housing over the rasping drums for protection to the operator from flying particles and shavings.

U.S. Pat. No. 2,821,216 to West et al discloses a portable chain saw attachment for clearing fire lanes. In its primary form, the West et al attachment comprises four flails arranged on a shaft at the sides of a chain driven sprocket. West et al also discloses the use of a spiral cutting blade on a drum for cutting a trench.

And U.S. Pat. No. 2,889,860 to Bagley teaches a debarking adapter for a chain saw having a rotating cutter mounted thereon. The cutter consists of a block mounting four cutter blades.

SUMMARY OF THE INVENTION

In accordance with the present invention, I provide a special cutting head assembly attached to the end of the saw bar. The cutting head assembly is rotated by the chain saw motor using the saw chain for power transmission. The cutting head assembly includes two wheels each of which has a central axial aperture and means for holding a plurality of cutting knives. A drive sprocket is positioned between the two wheels and it is adapted to receive and be driven by the saw chain.

The cutting knives are individually positioned in mounting means in the perimeters of the two wheels and are held in the mounting means by individual securing means. Thus, the cutting knives can be individually removed for sharpening.

An axle extends through the central axial apertures of the two wheels and the ends of the axle extend normally outwardly from the center of the wheels. Two mounting arms receive the ends of the axle and they are adapted to be secured to the saw bar so that the axle (and the corresponding axis of the cutting head assembly) is held in a plane perpendicular to the plane of the saw bar.

My invention will quickly cut a clean ring around a log by removing the bark and foreign material. This greatly reduces the time lost in chopping the foreign material from trees and logs or in sharpening saw chains, thereby permitting the operator to work more economically and efficiently.

My invention can also be used to cut joints in logs, to hollow out logs (for example, to make canoes), to carve logs (for example, to make totem poles), and to notch stumps (for example, to make a guy line tie down).

BRIEF DESCRIPTION OF THE DRAWINGS

The details of my invention will be described in connection with the accompanying drawings in which.

DESCRIPTION OF THE PREFERRED EMBODIMENTS

Figure 8:
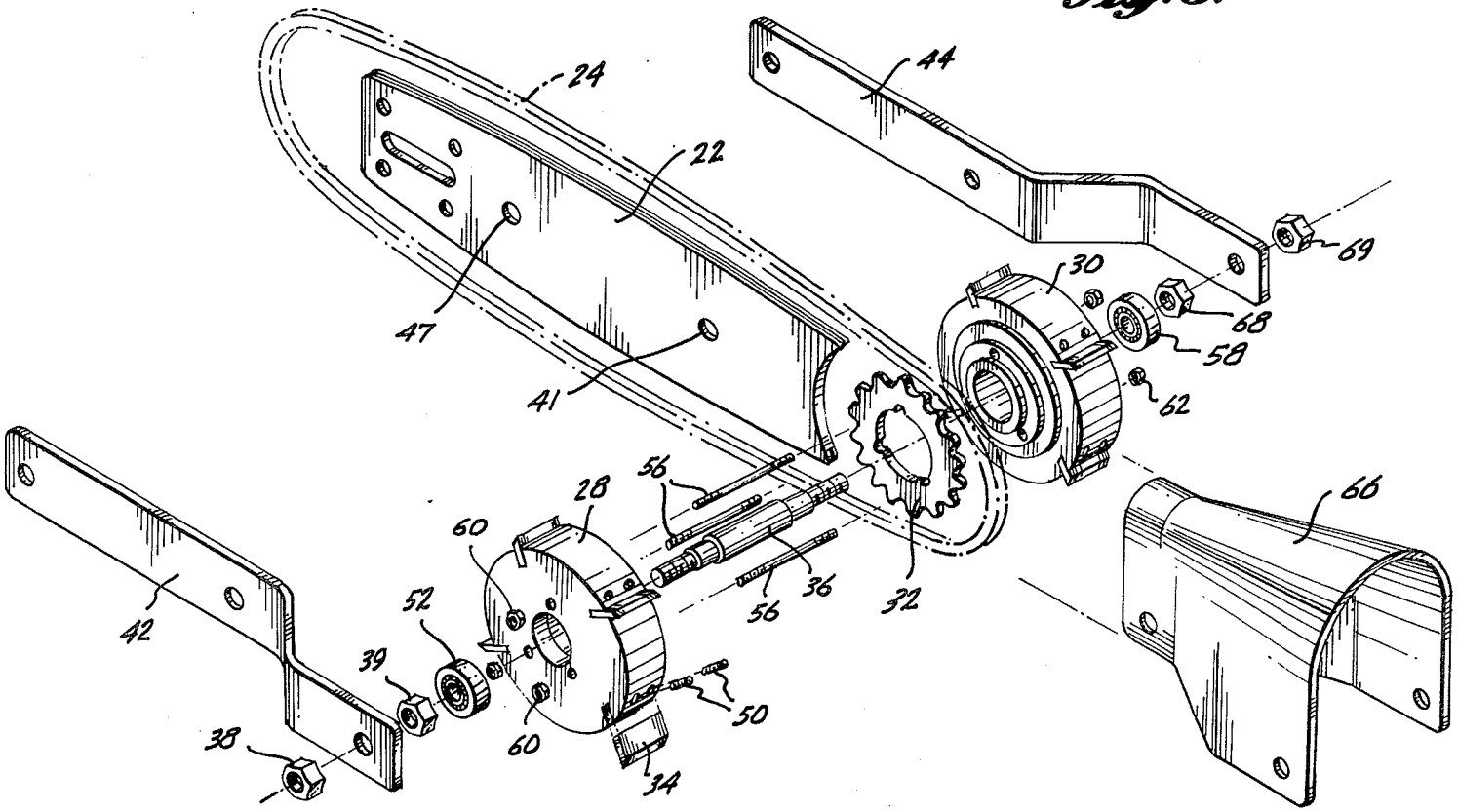
FIG. 8 is an exploded view of the embodiment shown in FIG. 6.

Referring now to the drawings and first with reference to FIGS. 1–5 and FIG. 8, the chain saw attachment 20 is adapted to be mounted on a conventional portable power-driven chain saw. The saw bar 22 extends outwardly from the motor (not shown) and has the endless saw chain 24 trained therearound. The saw chain 24 is driven in a conventional manner by the power source. The aforesaid parts of the chain saw are of conventional construction with the exception that the distal end of the saw bar 22 is cut concavely to match the curvature of the cutting head assembly 26 as shown in FIG. 8. The saw chain 24 may also be shortened (or elongated if needed) to adjust to the length of the saw bar 22 and the added chain saw attachment 20.

The cutting head assembly 26 consists of a first wheel 28, a second wheel 30, a drive sprocket 32, eight cutting knives 34, sixteen set screws 35, and three bolts 56. The cylindrical wheels 28 and 30 each have a central axial aperture and are relatively wide as shown. They are typically made of steel. The drive sprocket 32 is located between the wheels 28 and 30 and is sized to fit the pitch of the saw chain used in the particular power chain saw. The drive sprocket 32 is also typically made of steel.

The bolts 56 hold closely together, in a unitary assembly, the wheels 28 and 30 and the sprocket 32.

The cutting knives 34 are quadrantly placed around the perimeter of the wheels 28 and 30 in slots which have been machined into the body of each wheel. The cutting knives 34 are preferably made of hardened steel. They are individually held in their respective slots by two set screws 50. Thus, one of the important advantages of this invention is that the knives 34 are individually removable for sharpening. The cutting knives 34 are preferably about one inch wide and about 0.200 inches thick. Another important advantage of this invention is that the wheels 28 and 30 are close together so that the cutting knives 34 and the saw chain 24 (disposed between the cutting knives) make substantially one continuous cutting swath. The cutting knives 34 and the saw chain 24 have substantially the same radius.

The cutting head assembly 26 is supported on the central axle 36 by the associated bearings 52 and 58 shown in FIG. 8. The axle 36 is threaded at each end to receive nuts 38, 39, 68, and 69. Bearings 52 and 58 may be ball or roller bearings (as shown) or they may be bronze bushings. The axle 36 may be drilled and tapped to receive appropriate grease fittings to lubricate the bearings 52 and 58.

The axle 36 is, in turn, supported by angled mounting arms 42 and 44 which are secured on the respective planar faces of the saw bar 22 by bolts 40 and 46. As shown in FIGS. 1–5, the mounting arms 42 and 44 hold the axle 36 in a plane which is perpendicular to the plane of the saw bar 22.

One way to assemble the chain saw attachment 20 on the saw bar 22 is as follows. The saw chain 24 is removed and holes 41 and 47 are drilled in the saw bar. As mentioned earlier, the distal end of the saw bar 22 is cut concavely to match the curvature of the cutting head assembly 26. The cutting head assembly 26 is then placed on the axle 36 and the mounting arms 42 and 44 are secured to the ends of the axle 36 by the nuts 38, 39, 68, and 69. The mounting arms 42 and 44 are then placed over the saw bar 22 and secured by the bolts 40 and 46. Finally, the saw chain 24 is trained around the saw bar 22 and engages the teeth in the drive sprocket 32.

As will be apparent, the cutting head assembly 26 may then be rotated in a forward direction by the saw chain 24 when the chain saw motor is operated. Moving the rotating cutting head assembly 26 around the log face quickly debarks the log and makes a relatively wide clean groove in which a conventional chain saw may then operate to accomplish the desired cutting of the log. Other uses of the chain saw attachment 20, such as to hollow out canoes, will be apparent from the foregoing.

Figure 1:
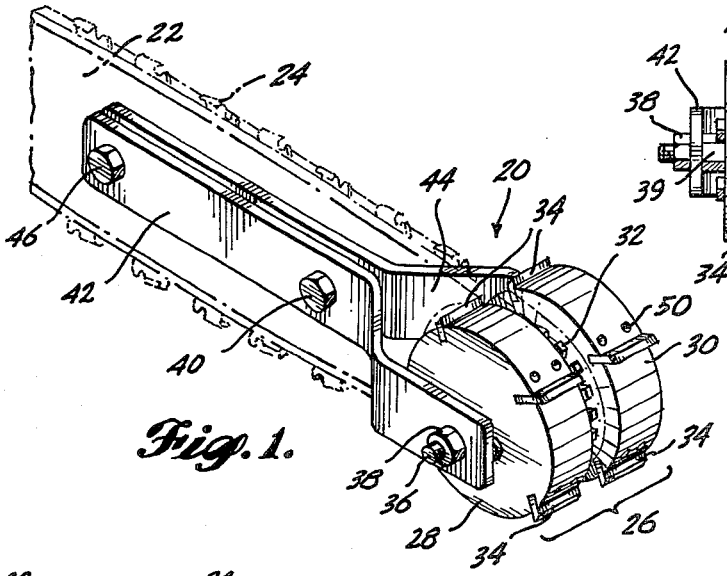
FIG. 1 is an isometric view from an upper and frontal aspect showing one embodiment of my chain saw attachment.
Figure 4:
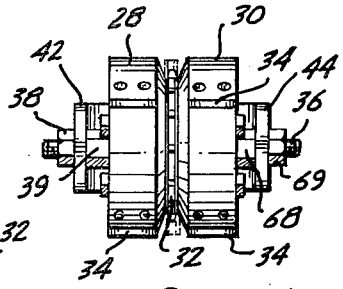
FIG. 4 is a front elevational view thereof.
Figure 2:
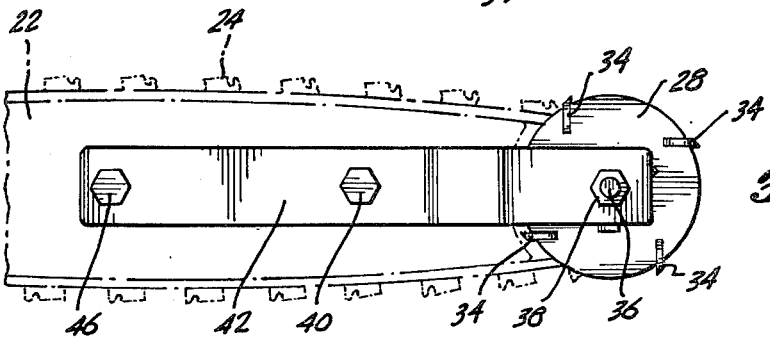
FIG. 2 is a side elevational view thereof.
Figure 3:
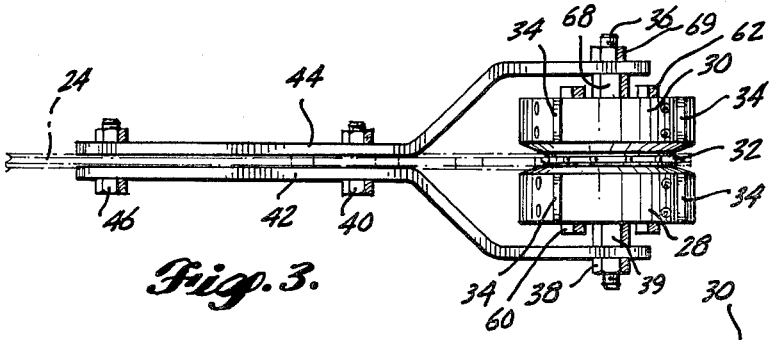
FIG. 3 is a top plan view thereof.
Figure 5:
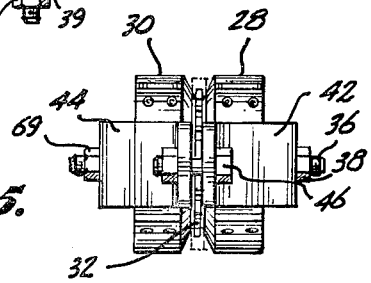
FIG. 5 is a rear elevational view thereof.

As shown in FIG. 1, the first embodiment of the invention does not include a cover. In this form, the chain saw attachment may be used for all of the previously mentioned purposes and also to clean the bottom side of a log by using the upper portion of the cutting head assembly 26.

Figure 6:
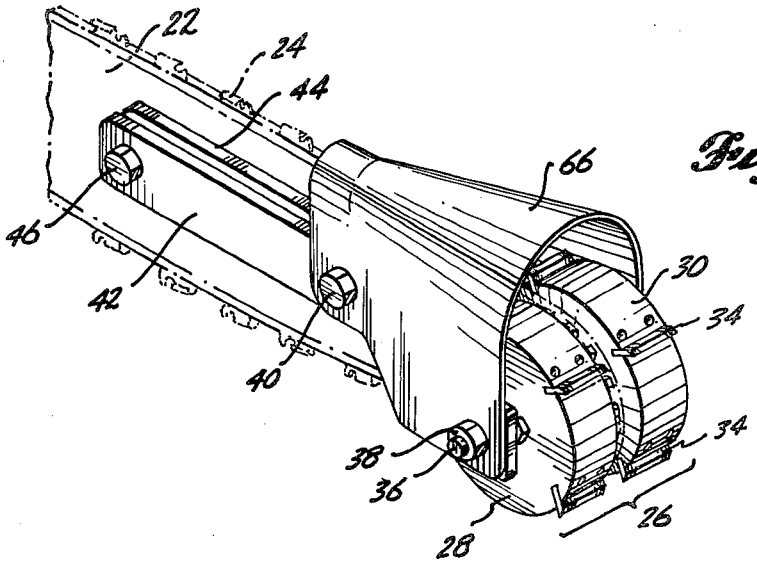
FIG. 6 is an isometric view from an upper and frontal aspect of a second embodiment of my invention, which is the same as the first embodiment shown in FIG. 1 with one form of a safety cover added.
Figure 7:
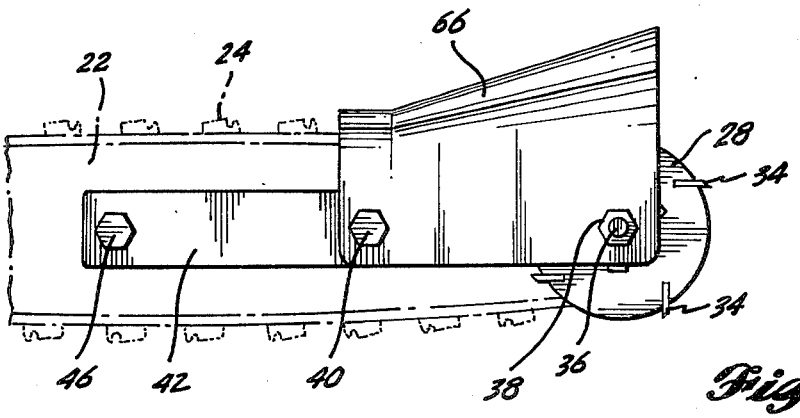
FIG. 7 is a side elevational view of the second embodiment shown in FIG. 6.

FIGS. 6–8 illustrate a second embodiment of the invention wherein the relatively fixed safety cover or shield 66 made of sheet metal is located above the cutting head assembly 26 to protect the operator from flying debris. The safety cover 66 is secured to the mounting arms 42 and 44 by the bolt 40 and by the nuts 38 and 69 on axle 36.

Figure 9:
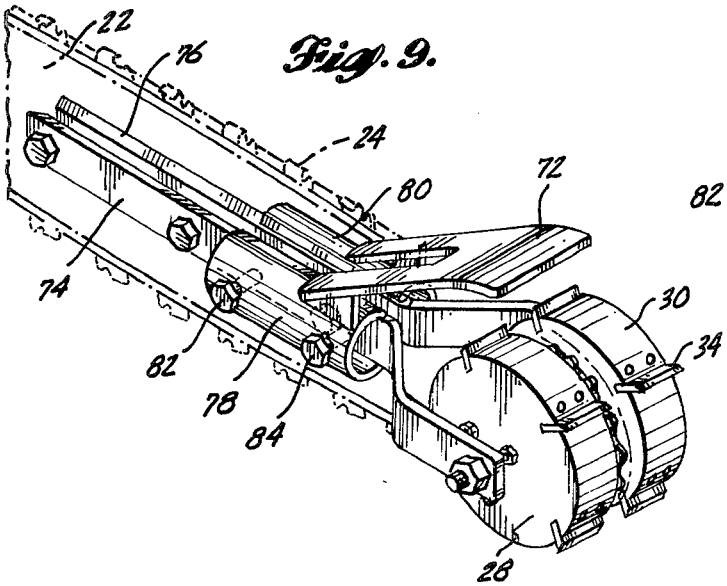
FIG. 9 is an isometric view from an upper and frontal aspect of a third embodiment of my invention, which is the same as the first embodiment shown in FIG. 1 with a second form of safety cover added.
Figure 11:
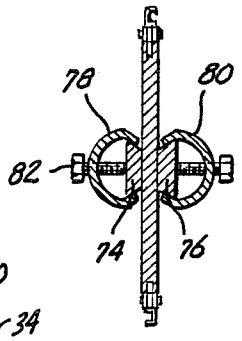
FIG. 11 is a vertical cross-sectional view of the chain saw attachment taken along a plane as indicated by the line 11—11 in FIG. 10.
Figure 10:
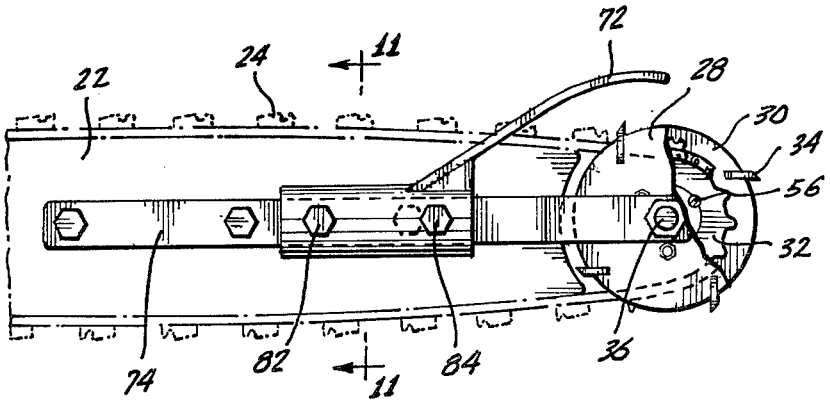
FIG. 10 is a side elevational view of the embodiment shown in FIG. 9.

FIGS. 9–11 illustrate a third embodiment of the invention wherein the relatively movable safety cover or shield 72 made of heavy gauge metal is located above the cutting head assembly 26. The safety cover 72 is narrower than the safety cover 66 shown in FIGS. 6–8. Thus, the safety cover 72 provides the operator with a better view of the ongoing cutting operation. In this version, the proximal ends of the safety cover 72 are welded to the semi-circular gripping members 78 and 80 which in turn fit on the mounting arms 74 and 76. As shown in FIG. 11, the upper and lower edges of the mounting arms 74 and 76 in this embodiment are beveled so that the gripping members 78 and 80 can slide along the mounting arms 74 and 76. The bolts 82 and 84 permit the gripping members 78 and 80 to be locked into position. By loosening the bolts 82 and 84, the safety cover 72 may be moved backward on the mounting arms 74 and 76 for cleaning. The safety cover 72 also may be moved completely to the rear and removed, thereby allowing the operator to work without a cover to debark the bottom side of a log as previously described.

The above-described embodiments are intended to be illustrative, not restrictive. The full scope of the invention is defined by the claims, and any and all equivalents are intended to be embraced.

What is claimed is:

1. A chain saw attachment for mounting on a portable power-driven chain saw having a saw bar and an endless saw chain disposed for movement around said bar, said chain saw attachment comprising:

(a) a cutting head assembly including:

(1) a first cylindrical wheel, said wheel having a central axial aperture and mounting means in the perimeter of said wheel for holding a plurality of cutting knives;

(2) a second cylindrical wheel, said wheel having a central axial aperture and mounting means in the perimeter of said wheel for holding a plurality of cutting knives;

(3) a drive sprocket positioned between said first and second wheels, said sprocket being adapted to receive and be driven by said saw chain;

(4) a plurality of cutting knives, said cutting knives being individually positioned in said mounting means in the perimeters of said first and second wheels and held in said mounting means by individual securing means; and (5) securing means for holding closely together in a unitary assembly said first and second wheels and said drive sprocket;

(b) an axle extending through the central axial apertures of said first and second wheels, the ends of said axle extending normally outwardly from the center of said wheels;

(c) first and second mounting arms receiving the ends of said axle, said mounting arms being adapted to be secured to said saw bar so that said axle is held in a plane perpendicular to the plane of the saw bar, said mounting arms having beveled edges; and (d) a safety cover located above said cutting head assembly, said safety cover being joined to gripping means which slidably fit on said beveled edges of said first and second mounting arms.

2. The chain saw attachment defined in claim 1, wherein said cutting knives are about one inch wide, about 0.200 inches thick, and are made of hardened steel.

3. The chain saw attachment defined in claim 1, wherein said mounting means in the perimeters of said first and second wheels are slots in said wheels.

4. The chain saw attachment defined in claim 1, wherein the cutting knives and the saw chain have substantially the same radius and make substantially one continuous cutting swath.

5. The chain saw attachment defined in claim 1, wherein the securing means holding said cutting knives in the perimeters of said first and second wheels are set screws.

* * * * *